US006215508B1

(12) United States Patent
Bryan et al.

(10) Patent No.: US 6,215,508 B1
(45) Date of Patent: Apr. 10, 2001

(54) REVERSE IMAGE PRINTING APPARATUS, CARTRIDGE AND LABEL, AND METHOD OF MAKING THE SAME

(76) Inventors: Robert A. Bryan, 7601 Harold Ave., Golden Valley, MN (US) 55427; Yoshitaka Namiki, 933 Brandon Ave., Simi Valley, CA (US) 93065

( * ) Notice: Subject to any disclaimer, the term of this patent is extended or adjusted under 35 U.S.C. 154(b) by 0 days.

(21) Appl. No.: 09/036,055

(22) Filed: Mar. 6, 1998

Related U.S. Application Data

(60) Provisional application No. 60/062,463, filed on Oct. 15, 1997.

(51) Int. Cl.[7] ..... B41J 2/325; B41J 32/00
(52) U.S. Cl. ..... 347/171; 347/214
(58) Field of Search ..... 347/171, 213, 347/214; 400/207, 120.01; 40/299.01, 638

(56) References Cited

U.S. PATENT DOCUMENTS 5,053,788 * 10/1991 Tohdo ..... 347/171
5,443,318 * 8/1995 Kitazawa ..... 400/120.01

* cited by examiner

*Primary Examiner*—Huan Tran
(74) *Attorney, Agent, or Firm*—Pillsbury Madison & Sutro LLP

(57) ABSTRACT

A printing apparatus for generating an image which includes a housing, a ribbon supply holder, a tape supply holder, an input device, a thermal printing head and a tape attachment device. The ribbon supply holder is operatively coupled to the housing to hold a supply of ink ribbon. The ink ribbon includes a film layer with an ink layer disposed thereon, and a receptor layer for receiving ink from the film layer. The tape supply holder is operatively coupled to the housing to hold a supply of tape, and the tape includes an adhesive layer. The input device is operatively coupled to the housing to enter data used to generate the image by the printing apparatus. The thermal printing head is operatively coupled to the housing to print the entered data on the ink ribbon. The tape attachment device attaches the tape to the film layer of the ink ribbon. Preferably, the thermal printing head generates the image by leaving a portion of the ink layer, representing the image corresponding to the data, on the film layer such that a negative of the image is transferred to the receptor layer, and the tape attachment device attaches the adhesive layer of the tape to the film layer to sandwich the remaining portion of the ink layer between the film layer and the adhesive layer. An ink jet printhead may be used instead of a thermal printhead.

27 Claims, 7 Drawing Sheets

30
38
40
43
44
45
46
47
48
49
50
52
52
120
115'
115
110
120
135
140
145
150
145
135
150
140
115
110
130
160

314
30
316
318
322
320
218
216
120
115'

43
40
46
130
48
47
49
52
52
50
44
160
38
115
110
135
140
145
150

REVERSE IMAGE PRINTING APPARATUS, CARTRIDGE AND LABEL, AND METHOD OF MAKING THE SAME

This application claims benefit of Provisional application Ser. No. 60/062,463 filed Oct. 15, 1997.

FIELD OF THE INVENTION

This invention relates to thermal and ink jet image printing apparatuses, cartridges and labels and, in particular embodiments, to a reverse image printing apparatus to provide improved images with greater durability.

BACKGROUND OF THE INVENTION

Traditionally, thermal printing is used to produce labels that can be applied to objects such as containers, books, computer disks, equipment or the like. Typical thermal image label printers are manufactured by Brother of Japan and Kroy, Inc. of Scottsdale, Ariz.

Generally, thermal image printers provide input capabilities, power and a housing designed to accept a label cartridge containing the material used to form the label. The label cartridge generally includes one or more spools of material that are combined and fed over a thermal printing head to generate an image on a label.

In conventional systems, the label is formed from three basic components: a plastic or wax ink coated on a plastic ribbon film, a paper or plastic ink receiving layer, and an adhesive backing layer.

In operation, the plastic ribbon with the ink and receiving layer are passed over the heating element of the thermal printing head, which melts the ink on the plastic ribbon so that it adheres to the receiving layer. The heating element is selectively heated, based on the input to the printing apparatus, to print letters, symbols or the like, on the receiving layer, while leaving ink on the plastic film that is not needed to form the image. After the plastic ribbon and receiving layer are passed over the heating element, the plastic ribbon is removed from the receiving layer to expose the image produced on the receiving layer. If the adhesive backing has not already been applied to the back of the receiving layer, opposite the side that received the ink, the adhesive layer is applied to the receiving layer and the final label is outputted from the cartridge and the printer. Once outputted, the label may be applied to an object for identification.

Labels produced by this method of printing have several drawbacks. First, since the ink is melted onto the receiving layer, the image tends to blur around the edges, with the amount of blurring being dependent on the type of ink and the type of receiving layer. Second, the image produced on the receiving layer is exposed and can be affected by light, weather or rubbing so that the image on the label is ultimately unusable and must be replaced.

To overcome these drawbacks, better inks and receiving layers have been produced to provide sharper images. However, these procedures increase costs. In addition, laminating a clear layer over the image on the receiving layer to cover and protect the image has been done. However, this step requires extra material and extra steps to produce the laminated product, which increases the cost of the label. Also, application of the clear layer may further blur the image, with the amount of blurring being dependent on the manner in which the clear layer is applied to the receiving layer.

Ink jet printers have also be used to generate labels. However, labels generated by inkjet printers suffer from many of the same drawbacks that thermal image labels suffered from. For example, the image is exposed and can be affected by light weather and rubbing so that the image on the label is ultimately unusable and must be replaced. Also, many ink jet inks are water based and subject to smearing and deterioration when exposed to moisture.

SUMMARY OF THE DISCLOSURE

It is an object of an embodiment of the present invention to provide an improved image printing apparatus, which obviates for practical purposes the above- mentioned limitations.

According to an embodiment of the invention, a printing apparatus for generating an image includes a housing; a ribbon supply holder, a tape supply holder, an input device, a thermal printing head and a tape attachment device. The ribbon supply holder is operatively coupled to the housing to hold a supply of ink ribbon. The ink ribbon includes a film layer with an ink layer disposed thereon and a receptor layer for receiving ink from the film layer. The tape supply holder is operatively coupled to the housing to hold a supply of tape, and the tape includes an adhesive layer. The input device is operatively coupled to the housing to enter data used to generate the image by the printing apparatus. The thermal printing head is operatively coupled to the housing to print the entered data on the ink ribbon. The tape attachment device attaches the tape to the film layer of the ink ribbon. In preferred embodiments, the thermal printing head generates the image by leaving a portion of the ink layer, representing the image corresponding to the data, on the film layer such that a negative of the image is transferred to the receptor layer, and the tape attachment device attaches the adhesive layer of the tape to the film layer to sandwich the remaining portion of the ink layer between the film layer and the adhesive layer. Other embodiments of the present invention include a cutter that is operatively coupled to the housing to cut the tape and the ribbon.

In additional embodiments, the printing apparatus further includes a cartridge casing for holding the ribbon supply holder, the tape supply holder and the thermal printer head. Also, the housing is adapted to receive the cartridge casing.

In another embodiment of the present invention, a cartridge for use in a printing apparatus for generating an image with a thermal printing head includes a housing, a ribbon supply holder, a tape supply holder, a tape attachment device and a drive mechanism. The ribbon supply holder is operatively coupled to the housing to hold a supply of ink ribbon. The ink ribbon includes a film layer with an ink layer disposed thereon, and a receptor layer for receiving ink from the film layer. Then a tape supply holder is operatively coupled to the housing to hold a supply of tape, and the tape includes an adhesive layer. The tape attachment device attaches the tape to the film layer of the ink ribbon. The drive mechanism is operative to feed the ink ribbon and the tape through the cartridge to generate the image. The cartridge is formed so that when the thermal printing head generates the image, it leaves a portion of the ink layer, representing the image corresponding to the data on the film layer such that a negative of the image is transferred to the receptor layer, and the tape attachment device attaches the adhesive layer of the tape to the film layer to sandwich the remaining portion of the ink layer between the film layer and the adhesive layer.

In further embodiments, the cartridge further includes a receptor layer stripping mechanism that strips the receptor layer from the ink ribbon after the thermal print head prints the image representing the data. In addition, the tape attachment device attaches the tape to the ink layer after stripping the receptor layer. In additional embodiments, the tape further includes a base film layer attached to the adhesive layer, a second adhesive layer attached to the base film layer and a release liner layer attached to the second adhesive layer to produce a label that has a protected second adhesive layer to facilitate application of the label to a surface. Also, the release liner layer can be peeled of the second adhesive layer to attach the second adhesive layer to the surface.

Yet another embodiment of the present invention is directed to a label formed with a printing apparatus for generating an image with a thermal printing head that includes an ink ribbon and a tape having an adhesive layer. The ink ribbon includes a film layer with an ink layer disposed thereon, and a temporary removable receptor layer for receiving ink from the film layer prior to removal of the receptor layer. When the thermal printing head generates the image, it leaves a portion of the ink layer, representing the image corresponding to the data, on the film layer such that a negative of the image is transferred to the receptor layer prior to removal of the receptor layer, and the adhesive layer of the tape is attached to the film layer to sandwich the remaining portion of the ink layer between the film layer and the adhesive layer.

In further embodiments of the present invention, the tape further includes a base film layer attached to the adhesive layer, a second adhesive layer attached to the base film layer and a release liner layer attached to the second adhesive layer so that the label produced has a protected second adhesive layer to facilitate application of the label to a surface. Also, the release liner layer can be peeled off the second adhesive layer to attach the second adhesive layer to the surface.

Still another embodiment of the present invention is directed to a method of producing labels. The steps include: a) receiving data to be printed on the labels; b) advancing an ink ribbon through a thermal printing mechanism (where the ink ribbon includes an ink layer, a film layer covering the ink layer and a receptor layer); c) creating an image representing the data on the ink layer by creating a negative of the image on the receptor layer; and d) attaching a tape layer to the ink ribbon.

In further embodiments, the method includes the steps of: a) stripping the receptor layer from the ink ribbon after creating the image on the ink layer; and b) cutting a portion of the ink ribbon having the created image.

In an additional embodiment, a printing apparatus for generating an image includes a housing, a transparent film holder, a base film holder, and input device, a printing head and a base film attachment device. The transparent film holder is operatively coupled to the housing that holds a supply of transparent film. The base film holder is operatively coupled to the housing that holds a supply of base film, and the base film includes an adhesive layer. The input device is operatively coupled to the housing and enters data used to generate the image by the printing apparatus. The printing head is also operatively coupled to the housing and prints the entered data on the transparent film. The base film attachment device attaches the base film to the transparent film. In preferred embodiments, the printing head generates the image, representing the image corresponding to the data, on the transparent film so that a reverse of the image is formed on the transparent film. Then the base film attachment device attaches the adhesive layer of the base film to the transparent film to sandwich the image between the transparent film and the adhesive layer of the base film.

A label formed in accordance with the above-described printing apparatus for generating an image includes a transparent film, and a base film including an adhesive layer. When a printing head generates the image, representing the image corresponding to the data, on the transparent film a reverse of the image is transferred to the transparent film, and the adhesive layer of the base film is attached to the transparent film to sandwich the image between transparent film and the adhesive layer to form the label.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of the embodiments of the invention will be made with reference to the accompanying drawings, wherein like numerals designate corresponding parts in the several figures.

DETAILED DESCRIPTION OF THE PREFERRED EMBODIMENTS

Figure 1:
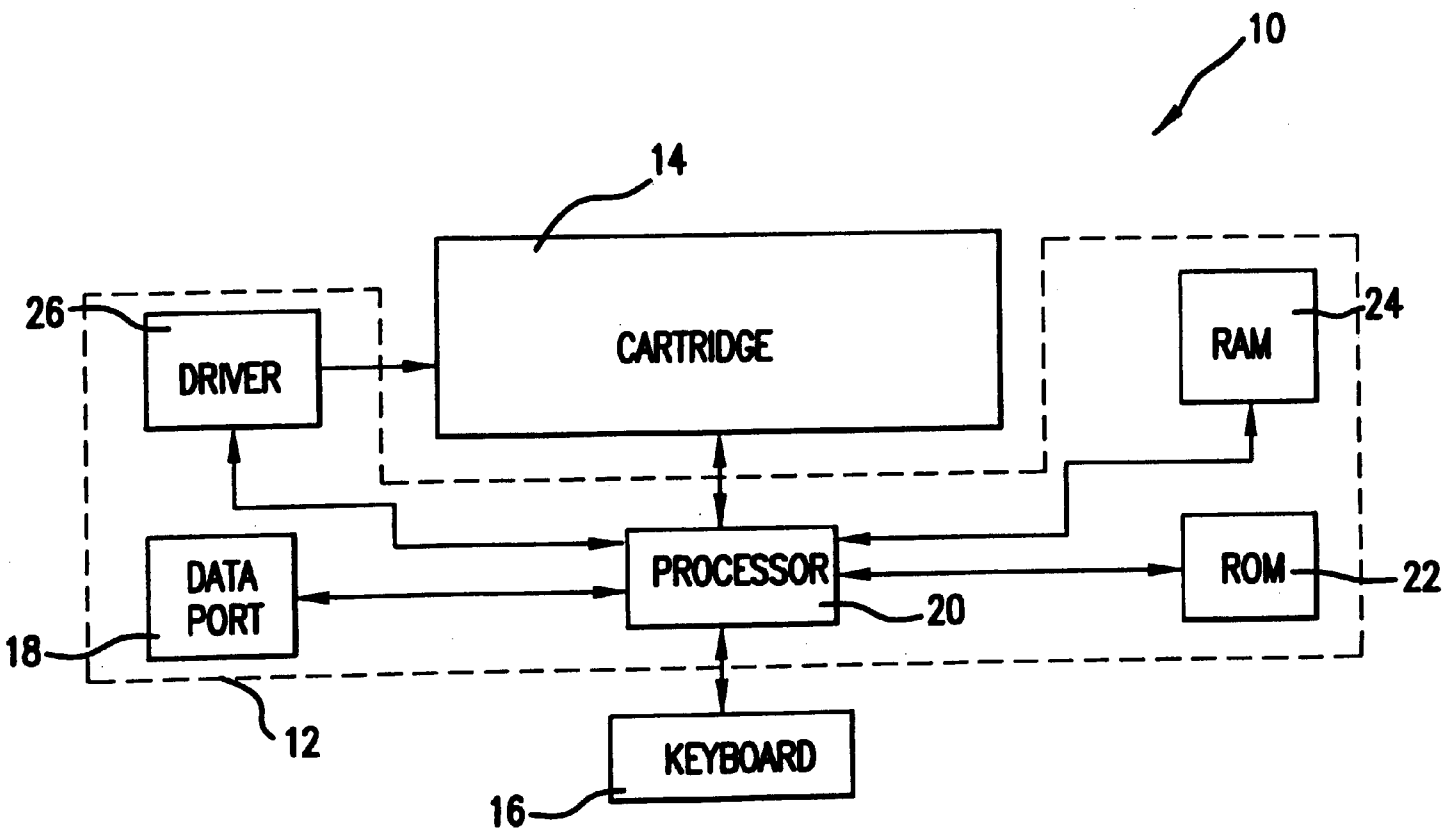
FIG. 1 is a block diagram of an apparatus in accordance with a first embodiment of the present invention.

As shown in the drawings for purposes of illustration, the invention is embodied in a reverse image thermal printer, cartridge and label. In preferred embodiments of the present invention, the reverse image printer produces labels from a cartridge to provide durable labels having well defined images. However, it will be recognized that further embodiments of the invention may be used to produce other attachable images such as pictures, decals, transfers or the like. In alternative embodiments, the printer is an ink jet printer that produces the reverse images for the labels or other types of printers capable of producing a reverse image; rather, than a thermal printer.

In preferred embodiments of the present invention, the images are formed with alphanumeric characters. However, in alternative embodiments, the image may be a bar code, picture or a combination of various images.

Reverse image printing used in accordance with a first embodiment of the present invention provides many advantages by utilizing the used portion of the ribbon (the film layer that is normally discarded) to produce a label or the like. In this process, the negative (or unwanted portion ) of an image is printed onto a receptor layer and the receptor layer is then discarded. This leaves the positive (or wanted portion) of the image on the film layer of the ribbon. The film layer is then laminated onto a tape backing and cut to the desired length to produce a finished label or the like. The label, or the like, that is produced in this manner tends to be very scratch and chemical resistant due to the fact that the printing is protected and sandwiched between the film layer and the tape backing.

The use of the film layer as part of the label to protect the image offers several advantages. For example, since the printed image is under a layer of film, the image is protected from abrasion, UV rays and chemicals. The use of a thin film layer also provides for the use of an conductive ink used to form a bar code. Typically, conductive bar codes must be covered by a non-conductive film. Thus, the non-conductive film layer provides a protective layer over the bar code and also provides the correct gap between the bar code and the inductive reader in a single manufacturing step.

In addition, images produced by reverse image printing tend to have better edge definition than conventional thermal transfer printing since the ribbon layer does not have to bond with the label stock to form the image. Also, reverse image printing eliminates the need to match the ink ribbon and label stock to produce a good image. Since sharper images are produced, the label does not require the use of more expensive resin ribbon to produce a durable image. A much less expensive alternative, such as wax ribbon, or the like, can be used. Also, since sharp images are easier to produce, heat control is less critical to produce a sharp image, which allows the software and hardware used to form the labels in a simpler and less expensive manner.

FIG. 1 illustrates a reverse image thermal printer 10 in accordance with an embodiment of the present invention. The printer 10 is formed from a housing 12 and a cartridge 14. The housing 12 is adapted to use a replaceable cartridge 14 that contains the materials or supply used to produce an image on a label, or the like. The housing includes a keyboard 16, a data port 18, a processor 20, a ROM 22, a RAM 24 and a driver 26. The keyboard 16 is used to input various commands and alphanumeric characters to be formed on the label or the like. Alternatively, or in addition to, a data port 18 may be provided to download image information and commands to the printer 10 from a laptop, personal computer or the like (not shown). The information from the keyboard 16 and/or data port 18 is supplied to a processor 20, which controls the printer 10 to produce labels from the materials or supply in the cartridge 14. Generally, programs for the printer 10 are stored in a ROM 22, and image data and/or variables are temporarily stored in a RAM 24, and are accessed by the processor 20 as needed. The processor 20 provides information to the cartridge 14 to produce the image on the label, and may also receive various information representing feedback and/or status of the cartridge 14. In addition, the processor 20 controls the driver 26 to operate the cartridge 14 and feed the materials or supply through the cartridge 14 to produce the labels. In alternative embodiments, various changes may be made to the printer 10 to provide additional capabilities, such as using a single custom chip, rather than a separate processor 20, ROM 22 and RAM 24. Also, the driver 26 may be formed as a part of the cartridge 14, rather than as a part of the printer 10.

Figures 2, 2A, 2B, 2C, 2D:
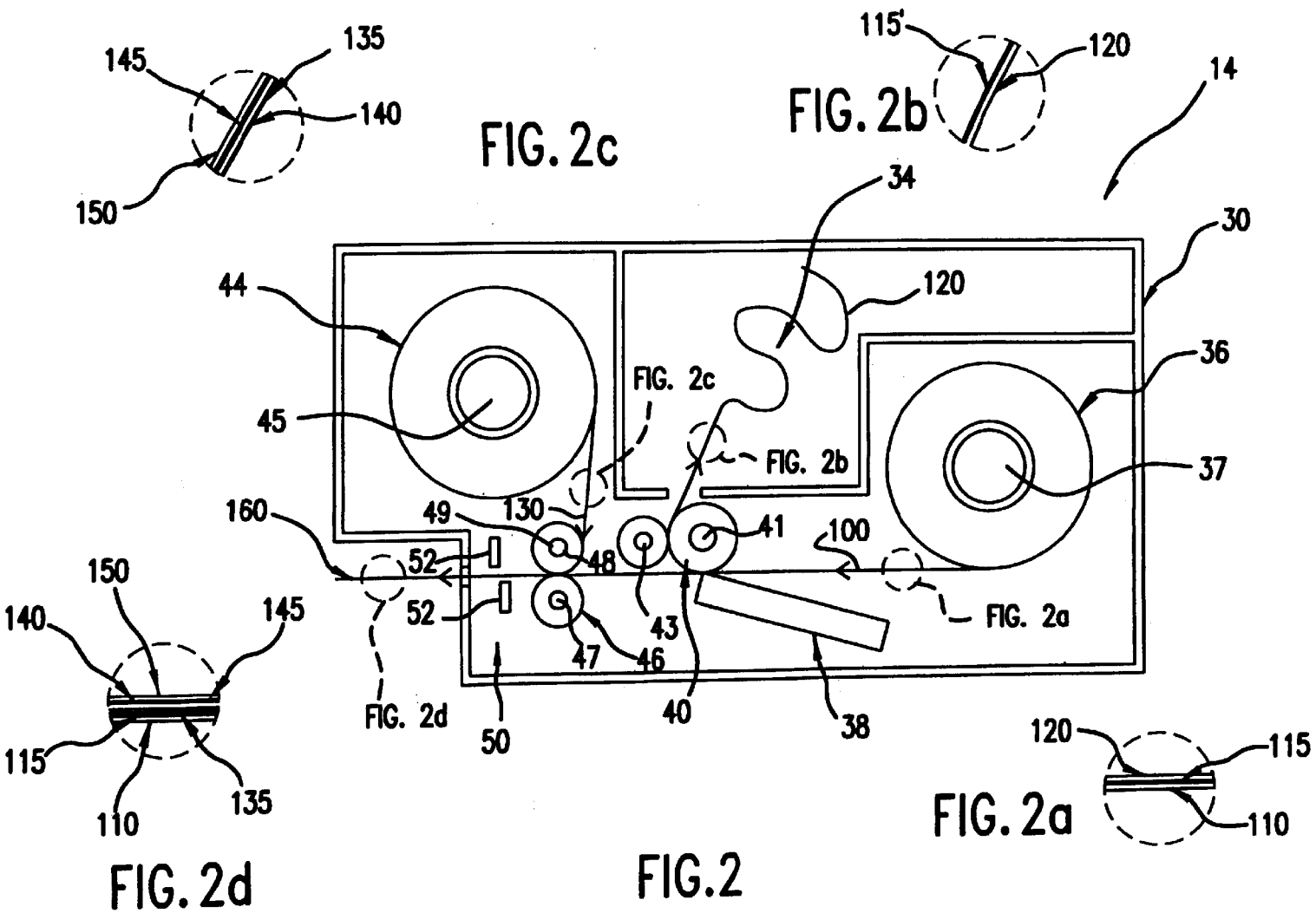
FIGS. 2–2*d* are schematic views of a cartridge for use with the apparatus of FIG. 1.

FIGS. 2–2*d* are schematics of a cartridge 14 for use with the housing 12 of the printer 10 shown in FIG. 1. The cartridge has a main body 30 that holds the materials, such as the ink ribbon 100 and the tape 130, and also mates with the driver 26 of the printer 10 to produce finished labels 160. The main body includes a partition 32 forming a dump box 34 for holding a discarded receptor layer 120 after the image has been formed on the film layer 110. Coupled to the main body 30 is an ink ribbon roll 36 on a post (or roller) 37 that supplies the ink ribbon 100 to a thermal printing head 38. The ink ribbon 100 is passed over the thermal printing head 38 between a platen roller 40 on a post (or roller) 41 to produce the image by heating the ink layer 115 to melt portions of the ink layer 1 15 onto a receptor layer 120 to form a negative image 115' of the image left behind on the film layer 110. The receptor layer 120 is then removed from the film layer 110 and ink layer 115 by being fed around the platen roller 40 and between a pinch roller 42 on a post (or roller) 43 so that it is directed into the dump box 34 for disposal. In preferred embodiments of the present invention, the image is produced at a resolution of 200 dots per inch. However, in alternative embodiments, other resolutions may be used, with the resolution being dependent on the application to which the label will be put.

The main body 30 also holds a tape roll 44 on a post (or roller) 45 that supplies the tape 130 to complete formation of the finished label 160. The film layer 110, the remaining ink layer 115 forming the image and the tape are fed between two additional pinch rollers 46 and 48 on corresponding posts (or rollers) 47 and 49 to press and secure the tape 130 to the film layer 110 and the remaining ink layer 115 to form the label, or the like. Finally, the main body includes a cutter 50 having blades 52 that cut the label at a desired length to form the finished label 160.

In preferred embodiments, the main body 30, the platen roller 40, and pinch rollers 42, 46 and 48 are made out of plastic. However, in alterative embodiments, other suitable materials may be used, such as metal, composites or the like. The remaining components are formed from suitable materials commonly used in thermal printing cartridges. In preferred embodiments, the cartridge 14 is disposable with a single use ink ribbon roll 36 and tape roll 44. However, in alternative embodiments, the cartridge 14 may be reused or recycled, and the end user may be able to replace the ink ribbon roll 36 and the tape roll 44, when needed.

Figure 3:
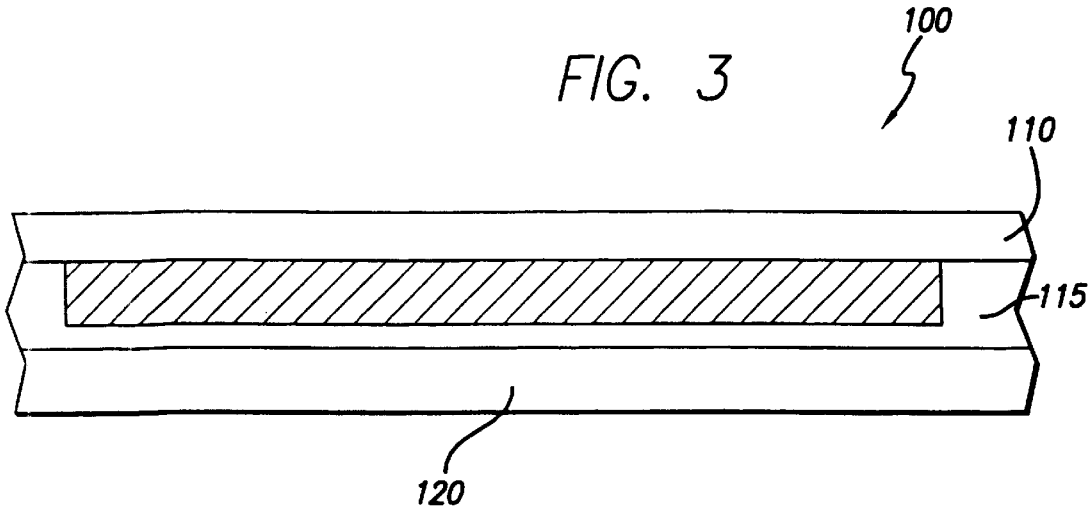
FIG. 3 is a detailed cross-sectional view of an ink ribbon used in the cartridge of FIG. 2.
Figure 4:
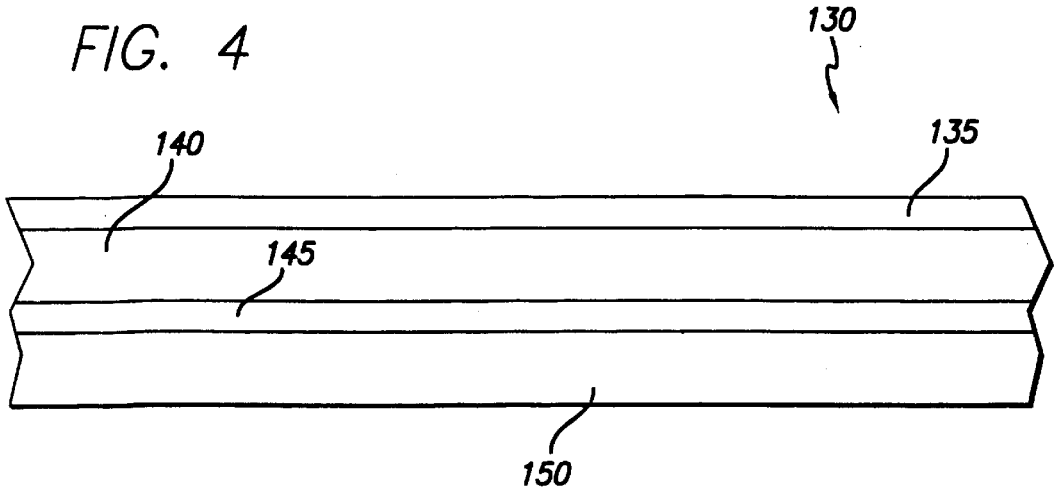
FIG. 4 is a detailed cross-sectional view of a tape used in the cartridge of FIG. 2.

Formation of a finished label 160 will now be described with reference to FIGS. 2–7. As shown in FIG. 3, the ink ribbon 100 is formed by a film layer 110 and a receptor layer 120 with an ink layer sandwiched between them. Generally, the film layer 110 is formed from plastic and the receptor layer 120 is formed from either paper or plastic. Preferably, wax inks are used to form the ink layer 115 to produce the sharpest images. However, in alternative embodiments, other inks such as resin, conductive inks, or the like, may be used. As shown in FIG. 4, the tape 130 is formed by an adhesive layer 135 disposed on a backing 140 to attach the tape 130 to the film layer 110 and the remaining ink layer 115 forming the image after the receptor layer 120 has been removed. The backing 140 is generally made from plastic. However, paper or other suitable materials may be used. On the opposite side of the adhesive 135 is another layer of adhesive 145 disposed on the back of the backing 140, which is used to hold a release liner 150 and ultimately to secure the label 160 to a surface. In preferred embodiments, the adhesive 135 is a permanent adhesive and the adhesive 145 is either a permanent adhesive or a removable adhesive. However, in alternative embodiments, different adhesives may be used, with the type being dependent on the type of label and surface to which the label will be applied. In alternative embodiments, different configurations of the ink ribbon 100 and the tape 130 may be formed with the configuration being selected based on the type of label and surface to which the label will be applied.

Figure 5:
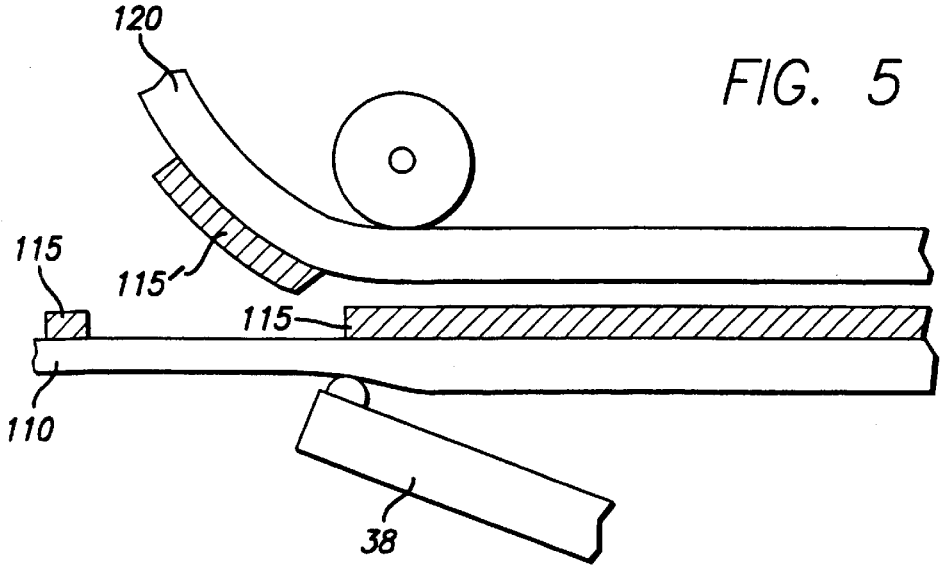
FIG. 5 is a detailed cross-sectional view of the ink ribbon of FIG. 3 as an image is produced.

As shown in FIG. 5, the ink ribbon 100 is passed between the thermal printing head 38 and the platen 40. Pixels on the thermal printing head 38 heat up to melt the ink layer 115 away from the film layer 110 so that it is transferred onto the receptor layer 120. The receptor layer 120 with the negative image 115' is then removed and discarded, as shown in FIGS. 2 and 2*b*. The remaining ink layer 115 on the film layer 110 is the final image, and the film layer 110 then serves as a transparent protective cover to protect the image.

Figure 6:
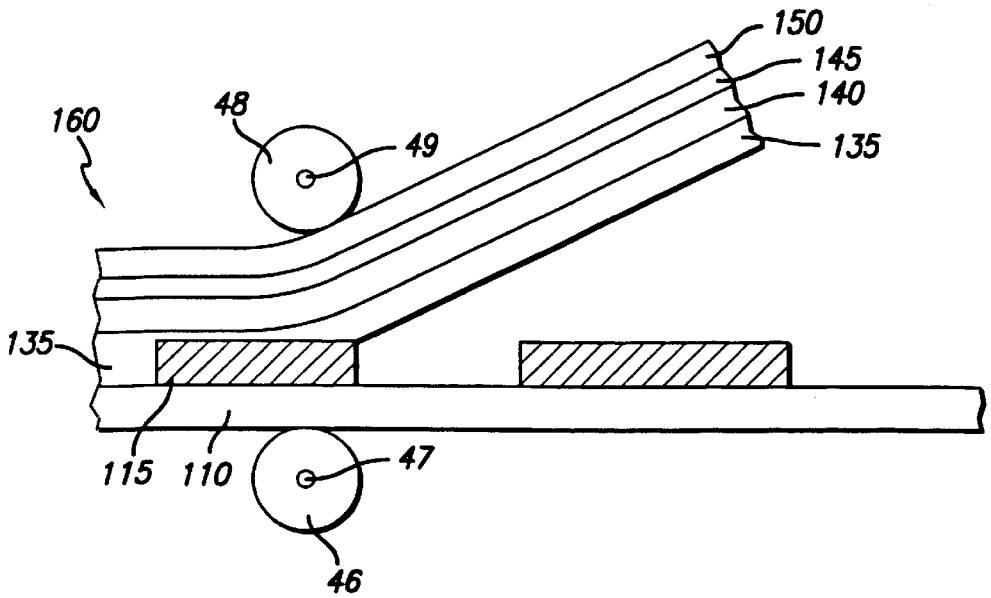
FIG. 6 is a detailed cross-sectional view of the tape being applied to the remaining ink ribbon after an image is produced to form the label.

As shown in FIG. 6, the tape 130 is applied to the remaining ink layer 115 and the film layer 110 by being passed through a pair of pinch rollers 46 and 48. The tape 130 is constructed from an adhesive layer 135 coated on a backing 140 and then another adhesive layer 145 for a release liner 150 to be peeled off easily. After the unwanted portions of the ink layer 115 are transferred onto the receptor layer 120 to be discarded, the remaining image on film layer 110 travels past the platen 40 and is joined with the tape 130. At this point, the printing process is completed and the label 160 is discharged from the cartridge 14. The cutter 50 at the exit of the cartridge 14 cuts off the label 160 so that it is finished and ready for use.

Figure 7:
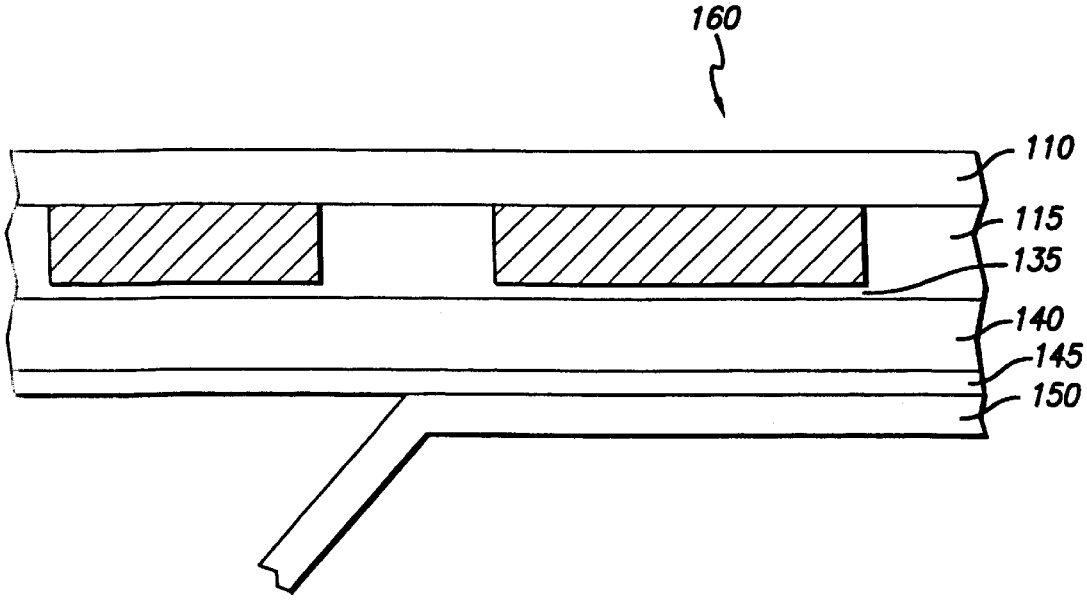
FIG. 7 is a detailed cross-sectional view of a portion of the tape being removed from the label prior to application to a surface.

As shown in FIG. 7, to use the label 160, the user peels off the release liner 150 by simply pinching the edge of the release liner and peeling it from the adhesive 145 on the backing 140. This exposes the adhesive 145 on the backing 140 so that it will serve as an adhesive to attach the label 160 onto a desired surface in a normal manner.

Figures 8, 8A, 8B, 8C, 8D:
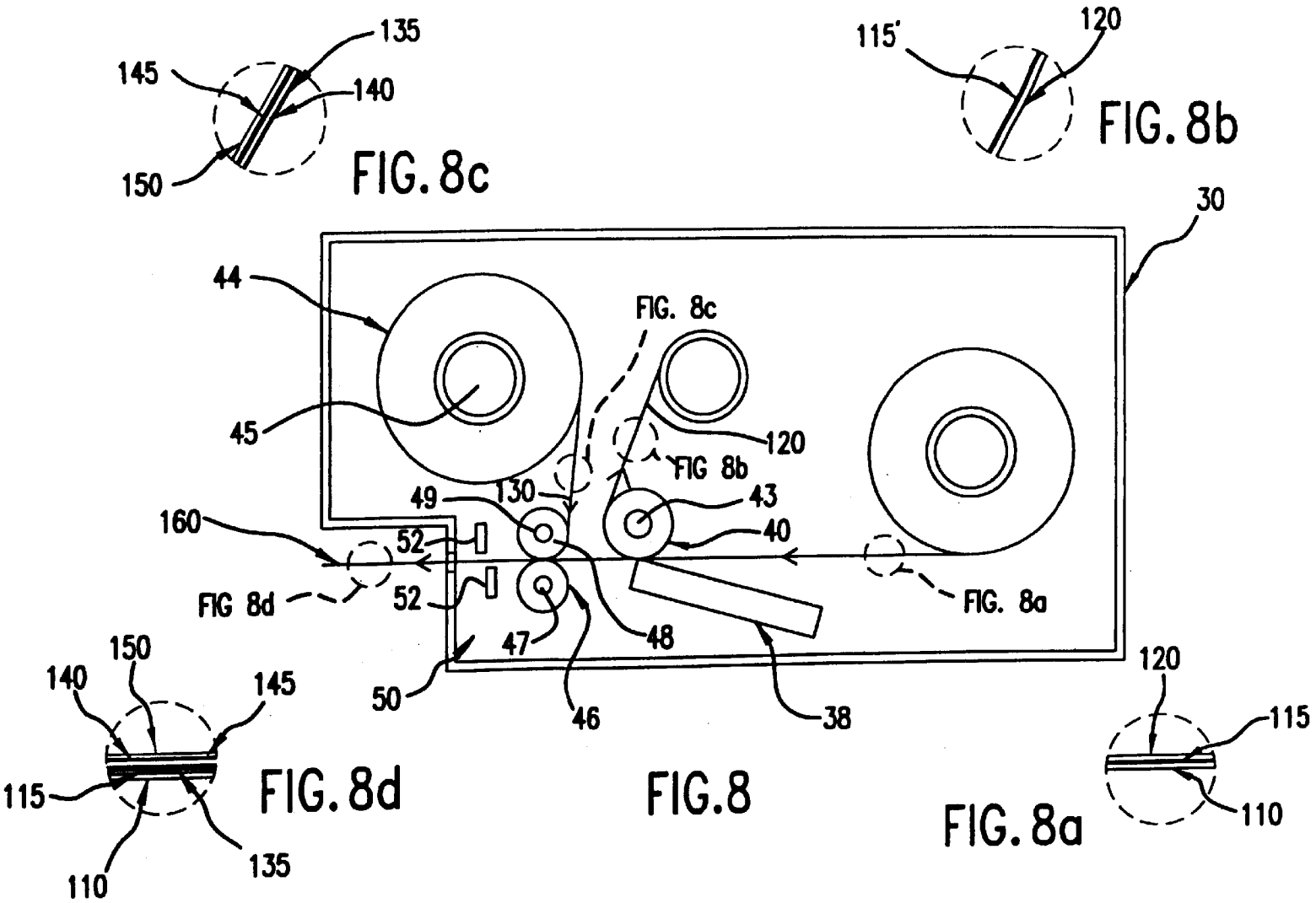
FIGS. 8–8*d* are schematic views of another cartridge embodiment for use with the apparatus of FIG. 1.

FIGS. 8–8*d* show another embodiment of a cartridge 214 for use with the printing apparatus shown in FIG. 1. Instead of a dump box 34, used to collect the discarded receptor layer 120 and negative image 115', the cartridge 214 uses a take up reel 216 on a post (or roller) 216. This type of mechanism tends to minimize jamming as discarded materials collect in the dump box 34 of the cartridge 14.

Figures 9, 9A, 9B, 9C, 9D:
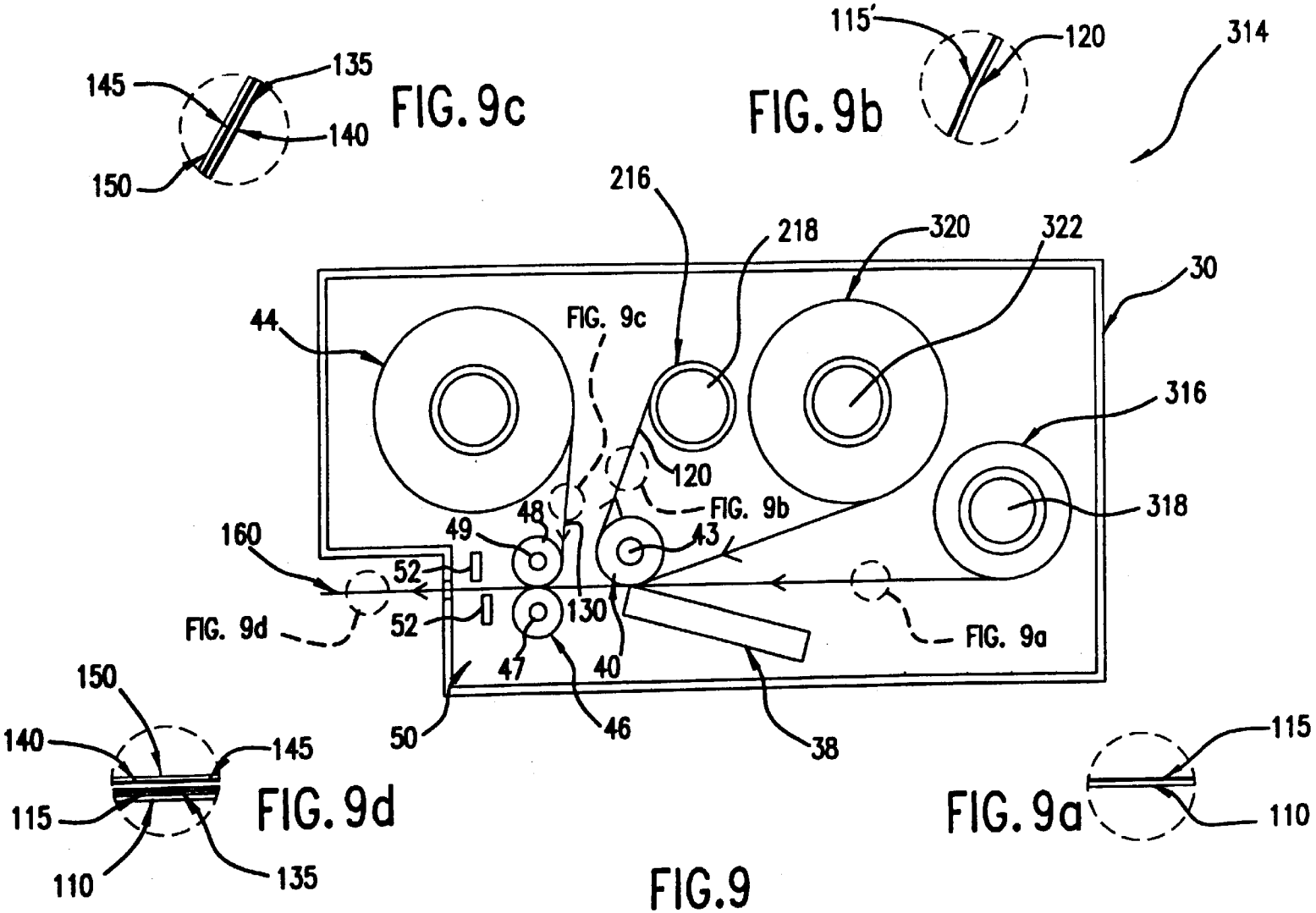
FIGS. 9–9*d* are schematic views of another cartridge embodiment for use with the apparatus of FIG. 1.

FIGS. 9–9*d* show another embodiment of a cartridge 314 for use with the printing apparatus shown in FIG. 1. This cartridge also uses a take up reel 216. However, in this embodiment, the film layer 110 with the ink layer is on a separate roll 316 on a post (or roller) 318, and a separate receptor roll 320 on a post (or roller) 322 to supply the film layer 110, ink layer 115 and receptor layer 120 to the thermal printing head 38. Advantages of this design are that there is versatility in selecting various receptor, film and ink layer combinations, and manufacture may be simplified by virtue of the various materials that may be used to produce the labels.

Figure 10A:
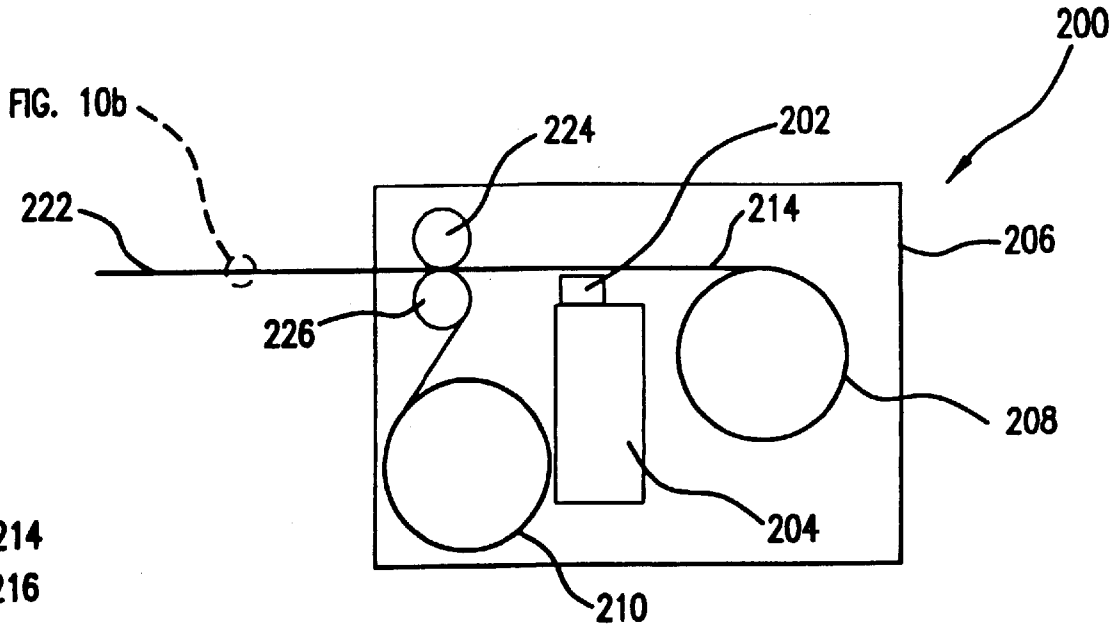
FIGS. 10*a* and 10*b* are schematic views of a reverse image printer in accordance with a second embodiment of the present invention.
Figure 10B:
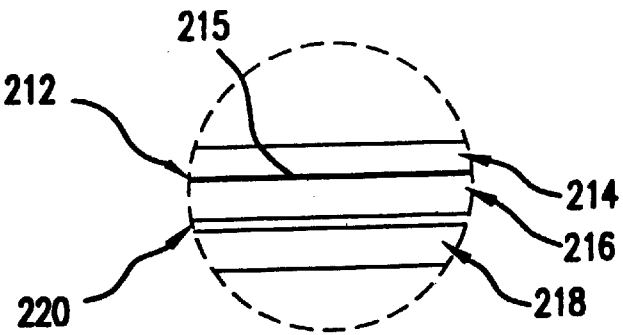

FIGS. 10*a* and 10*b* are schematic views of a reverse image printer 200 in accordance with a second embodiment of the present invention. The reverse image printer 200 includes an ink jet print head 202 and ink jet ink supply 204. The label material may be included in a cartridge 206 that includes a transparent film roll 208 and a base film roll 210. The inkjet head 202 produces a reverse image 212 on a transparent film 214, which is then applied to a base film 216 that includes a peel off film 218 secured to the base film 216 by an adhesive 220 to form a label 222. The base film 216 is secured to the transparent film 214 having the reverse image 212 by an adhesive on the base film 216. the base film 216 and the transparent film 214 are pressed together by two pinch rollers 224 and 226.

As shown in FIG. 10*b*, the base film 216 is formed by an adhesive layer 215 disposed on the base film 216 to attach the base film 216 to the transparent film 214 and the reverse image 212. The base film 216 is generally made from plastic. However, paper or other suitable materials may be used. On the opposite side of the adhesive 215 is another layer of adhesive 220 disposed on the back of the base film 216, which is used to hold a peel-off film 218 and ultimately to secure the label 222 to a surface. In preferred embodiments, the adhesive 215 is a permanent adhesive and the adhesive 220 is either a permanent adhesive or a removable adhesive. However, in alternative embodiments, different adhesives may be used, with the type being dependent on the type of label and surface to which the label will be applied. In alternative embodiments, different configurations of the label 22 using the tranparent film 214 and the base film 216 may be formed with the configuration being selected based on the type of label and surface to which the label will be applied.

In preferred embodiments of the present invention, the image 212 is produced at a resolution of 300 dots per inch. However, in alternative embodiments, other resolutions may be used, with the resolution being dependent on the application to which the label will be put.

Reverse image printing in accordance with this second embodiment of the present invention is similar to the reverse thermal imaging described above, and provides many same advantages to produce labels or the like. However, in this process, a reverse image is directly printed onto a transparent film and there is no discarded receptor layer. The transparent film is then laminated onto a tape backing and cut to the desired length to produce a finished label or the like. The label, or the like, that is produced in this manner tends to be very scratch and chemical resistant due to the fact that the printing is protected and sandwiched between the film layer and the tape backing.

The use of the transparent film as part of the label to protect the image offers several advantages. For example, since the printed image is under a layer of transparent film, the image is protected from abrasion, UV rays and chemicals. As described above, the use of a thin transparent film also provides for the use of an conductive ink used to form a bar code. Typically, conductive bar codes must be covered by a non-conductive film. Thus, the non-conductive transparent film provides a protective layer over the bar code and also provides the correct gap between the bar code and the inductive reader in a single manufacturing step.

The use of ink jet printing provides several advantages over thermal printing. The printing process may be faster, since ink jets tend to operate at higher speeds. Also, the use of an ink supply, rather than a transfer ribbon, would facilitate the production of color labels. Further, the use of an ink supply may minimize the waste of unused ink transferred from a ribbon. In addition, the ink may be manufactured to include adhesive properties, which could increase the durability of the produced label or the like.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A printing apparatus for generating an image, the printing apparatus comprising:

a housing;

a ribbon supply holder operatively coupled to the housing that holds a supply of ink ribbon, the ink ribbon including a film layer with an ink layer disposed thereon, and a receptor layer for receiving ink from the film layer;

a tape supply holder operatively coupled to the housing that holds a supply of tape, the tape including an adhesive layer;

an input device operatively coupled to the housing that enters data used to generate the image by the printing apparatus;

a thermal printing head operatively coupled to the housing that prints the entered data on the ink ribbon; and a tape attachment device that attaches the tape to the film layer of the ink ribbon, wherein the thermal printing head generates the image by leaving a portion of the ink layer, representing the image corresponding to the data, on the film layer such that a negative of the image is transferred to the receptor layer, and the tape attachment device attaches the adhesive layer of the tape to the film layer to sandwich the remaining portion of the ink layer between the film layer and the adhesive layer.

2. The printing apparatus of claim 1, further comprising a receptor layer stripping device that strips the receptor layer from the ink ribbon after the thermal print head prints the image representing the data.

3. The printing apparatus of claim 2, wherein the tape attachment device attaches the tape to the ink layer after stripping the receptor layer.

4. The printing apparatus of claim 1, further comprising a cutter operatively coupled to the housing that cuts the tape and the ribbon.

5. The printing apparatus of claim 1, wherein the tape further includes a base film layer attached to the adhesive layer, a second adhesive layer attached to the base film layer and a release liner layer attached to the second adhesive layer to produce a label that has a protected second adhesive layer to facilitate application of the label to a surface.

6. The printing apparatus of claim 5, wherein the release liner layer can be peeled off the second adhesive layer to attach the second adhesive layer of the label to the surface.

7. The printing apparatus of claim 1, further comprising a cartridge casing for holding the ribbon roll holder, the tape roll holder and the thermal printer head, and wherein the housing is adapted to receive the cartridge casing.

8. A cartridge for use in a printing apparatus for generating an image with a thermal printing head, the cartridge comprising:

a housing;

a ribbon supply holder operatively coupled to the housing that holds a supply of ink ribbon, the ink ribbon including a film layer with an ink layer disposed thereon, and a receptor layer for receiving ink from the film layer;

a tape supply holder operatively coupled to the housing that holds a supply of tape, the tape including an adhesive layer;

a tape attachment device that attaches the tape to the film layer of the ink ribbon; and a drive mechanism that is operative by the printing apparatus to feed the ink ribbon and the tape through the cartridge to generate the image, wherein the cartridge is formed so that when the thermal printing head generates the image it leaves a portion of the ink layer, representing the image corresponding to the data, on the film layer such that a negative of the image is transferred to the receptor layer, and the tape attachment device attaches the adhesive layer of the tape to the film layer to sandwich the remaining portion of the ink layer between the film layer and the adhesive layer.

9. The cartridge of claim 8, further comprising a receptor layer stripping mechanism that strips the receptor layer from the ink ribbon after the thermal print head prints the image representing the data.

10. The cartridge of claim 9, wherein the tape attachment device attaches the tape to the ink layer after stripping the receptor layer.

11. The cartridge of claim 8, wherein the tape further includes a base film layer attached to the adhesive layer, a second adhesive layer attached to the base film layer and a release liner layer attached to the second adhesive layer to produce a label that has a protected second adhesive layer to facilitate application of the label to a surface.

12. The cartridge of claim 11, wherein the release liner layer can be peeled off the second adhesive layer to attach the second adhesive layer to the surface.

13. A label formed with a printing apparatus for generating an image with a thermal printing head, the label comprising:

an ink ribbon including a film layer with an ink layer disposed thereon, and a temporary removable receptor layer for receiving ink from the film layer prior to removal of the receptor layer;

a tape including an adhesive layer, wherein when the thermal printing head generates the image, it leaves a portion of the ink layer, representing the image corresponding to the data, on the film layer such that a negative of the image is transferred to the receptor layer prior to removal of the receptor layer, and the adhesive layer of the tape is attached to the film layer to sandwich the remaining portion of the ink layer between film layer and the adhesive layer to form the label.

14. The label of claim 13, wherein the tape further includes a base film layer attached to the adhesive layer, a second adhesive layer attached to the base film layer and a release liner layer attached to the second adhesive layer so that the label produced has a protected second adhesive layer to facilitate application of the label to a surface.

15. The cartridge of claim 14, wherein the release liner layer can be peeled off the second adhesive layer to attach the second adhesive layer to the surface.

16. A method of producing labels, the method comprising the steps of:

receiving data to be printed on the labels;

advancing an ink ribbon through a thermal printing mechanism, the ink ribbon including a film layer with an ink layer disposed thereon, and a receptor layer for receiving ink from the film layer;

creating an image representing the data on the ink layer by creating a negative of the image on the receptor layer;

removing the receptor layer; and attaching a tape layer to the ink forming the image and the film layer.

17. The method of claim 16, further comprising cutting the label from the ink ribbon.

18. The method of claim 16, wherein the tape layer comprises a first and a second adhesive layers, a base film layer and a release liner layer.

19. The method of claim 18, further comprising the step of attaching the first adhesive layer to the image formed in the ink layer.

20. The method of claim 18, further comprising peeling off the release liner to expose the second adhesive layer and to attach the second adhesive layer to a desired surface.

21. A printing apparatus for generating an image, the printing apparatus comprising:

a housing;

a transparent film holder operatively coupled to the housing that holds a supply of transparent film;

a base film holder operatively coupled to the housing that holds a supply of base film, the base film including an adhesive layer;

an input device operatively coupled to the housing that enters data used to generate the image by the printing apparatus;

a printing head operatively coupled to the housing that prints the entered data on the transparent film; and a base film attachment device that attaches the base film to the transparent film, wherein the printing head generates the image, representing the image corresponding to the data, on the transparent film such that a reverse of the image is formed on the transparent film, and the base film attachment device attaches the adhesive layer of the base film to the transparent film to sandwich the image between the transparent film and the adhesive layer of the base film.

22. The printing apparatus of claim 21, further comprising a cutter operatively coupled to the housing that cuts the base film and the transparent film.

23. The printing apparatus of claim 21, wherein the base film further includes a base layer attached to the adhesive layer, a second adhesive layer attached to the base layer and a release liner layer attached to the second adhesive layer to produce a label that has a protected second adhesive layer to facilitate application of the label to a surface.

24. The printing apparatus of claim 23, wherein the release liner layer can be peeled off the second adhesive layer to attach the second adhesive layer of the label to the surface.

25. A label formed with a printing apparatus for generating an image with a printing head, the label comprising:

a transparent film;

a base film including an adhesive layer, wherein when the printing head generates the image, representing the image corresponding to the data, on the transparent film a reverse of the image is transferred to the transparent film, and the adhesive layer of the base film is attached to the transparent film to sandwich the image between transparent film and the adhesive layer to form the label.

26. The label of claim 25, wherein the base film further includes a base layer attached to the adhesive layer, a second adhesive layer attached to the base layer and a release liner layer attached to the second adhesive layer so that the label produced has a protected second adhesive layer to facilitate application of the label to a surface.

27. The label of claim 26, wherein the release liner layer can be peeled off the second adhesive layer to attach the second adhesive layer to the surface.

* * * * *